US006238746B1

(12) United States Patent
Fukuoka et al.

(10) Patent No.: US 6,238,746 B1
(45) Date of Patent: May 29, 2001

(54) METHOD OF AND APPARATUS FOR PAINTING VEHICLE BODIES WITH VARIOUS COLOR PAINTS

(75) Inventors: Hidemoto Fukuoka, Yokkaichi; Emitsu Tajima, Suzuka; Koutarou Hirata, Suzuka; Tetsuya Yasuda, Suzuka, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/382,810

(22) Filed: Aug. 25, 1999

(30) Foreign Application Priority Data

Aug. 27, 1998 (JP) ..... 10-257598

(51) Int. Cl.[7] ..... B05D 1/02

(52) U.S. Cl. ..... 427/424; 427/421; 427/426; 118/302; 118/324

(58) Field of Search ..... 427/421, 424, 427/426; 118/302, 324; 239/318, 307

(56) References Cited

U.S. PATENT DOCUMENTS 4,397,422 * 8/1983 Gwyn ..... 239/307

4,876,111 * 10/1989 Guyomard et al. ..... 427/426

FOREIGN PATENT DOCUMENTS 2-56281 * 2/1990 (JP) .

* cited by examiner

*Primary Examiner*—Katherine A. Bareford
(74) *Attorney, Agent, or Firm*—Liniak, Berenato, Longacre & White

(57) ABSTRACT

A painting method and a painting apparatus are disclosed, in which a few kinds of five to eight primary color paints are transferred along corresponding paint-transferring lines, and at a primary color paint selecting/extracting unit 6 provided at an intermediate of the painting apparatus 1 necessary primary color paints are selected and extracted for a certain amount and transferred into a paint-transferring passage 5, and then the extracted primary color paints are mixed at an agitating unit 7 provided at an intermediate of the paint-transferring passage 5 such that a suitable color paint having a certain viscosity is prepared. The suitable color paint thus prepared is then transferred to a spray gun G. A washing unit C is provided at the beginning end of the paint-transferring passage 5. When changing the color paint, the common paint-transferring passage 5 is cleaned by washing liquid ejected from the washing unit C. The cleaning operation is automatically controlled at a control unit 24 based on a previously input painting program.

3 Claims, 6 Drawing Sheets

METHOD OF AND APPARATUS FOR PAINTING VEHICLE BODIES WITH VARIOUS COLOR PAINTS

BACKGROUND OF THE INVENTION

1. Field of the Invention

The present invention relates to a method and an apparatus for painting vehicle bodies successively carried along a painting line with a suitable color paint selected from a variety of color paints.

2. Prior Art

In well-known prior art painting method, a vehicle body is coated in three different steps, i.e. primer coating for corrosion proofing with the use of electrodeposition coating method; surfacer painting for painting an intermediate coat such as gray color on the primer coating layer; and top coating for painting a desired paint on the intermediate coating layer. In top coating, a variety of different color paints (10 to 30 colors,) are applied to the vehicle bodies, which are successively carried along a conveyor and divided into groups according to a color paint to be applied. To this end, the painting apparatus comprises pluralities of parallel paint-transferring lines L1, L2, L3 . . . LN, such as shown in FIG. 6. The number of the paint-transferring lines corresponds to the variety of the color paints applied to vehicle bodies. At one end of the respective paint-transferring lines L1, L2, L3 . . . LN, a paint tank 35 is positioned so as to reserve a paint having a certain viscosity, which is prepared from different color paints to be mixed. Provided at the other end of these lines L1, L2, L3 . . . LN is a paint-changing unit 32 such as disclosed in Japanese Patent No. 1822017. The paint-changing unit 32 is used for in turn selecting a required color paint and transferring the selected color paint to a spray gun G.

In such painting apparatus, there is provided a washing unit C in parallel relation to the paint-transferring lines L1, L2, L3 . . . LN. When changing a color paint to be applied, the washing unit C ejects washing liquid into a connecting hose 33 between the paint-changing unit 32 and the spray gun G, thereby cleaning remaining paint within the hose. New color paint is then supplied to the spray gun G through the connecting hose 33 thus cleaned.

SUMMARY OF THE INVENTION

In the above conventional method and apparatus, since a variety of color paints are applied on the intermediate coating layer which is formed by a single common intermediate coat such as gray color, in most cases there are no similarities in hue between the paints applied for the surfacer painting and the top coating. In order to ensure uniform appearance of the top coating applied on the intermediate coating layer having non-similar hue, the top coating layer should be thicker such as 60 microns thick. This leads to increasing amount of the paints to be applied. Further, since top coating is also required for the reverse side of a trunk and the reverse side of a bonnet, where appearance of the coating layer is not normally required, operation for the top coating would be time-consuming. Moreover, since a large number of paint-transferring lines L1, L2 . . . are provided in parallel and each of the paint-transferring lines includes a flow control valve 31, the painting apparatus would be larger in its layout space and be complicated in its construction.

In the above conventional painting apparatus, since the paint-changing unit 32 for 10 to 30 kinds of top coating color paints would be larger in its size and weight, it is not mounted on an arm of a vehicle body painting robot, which holds the spray gun G. The paint-changing unit 32 is therefore attached to the factory building adjacent to the paint-transferring lines, and a huge length of connecting hose 33 connects the paint-changing unit 32 and the spray gun G. When the top coating color paint now in use is changed to another color paint, the remaining paint within the connecting hose 33 should be discharged. For this reason, washing liquid made from organic solvents is used for cleaning such huge length of connecting hose 33. As a result, a large amount of the washing liquid is required to clean the connecting hose 33 and a large amount of paint is discharged, leading to increasing amount of toxic liquid wastes from the factory as well as increasing amount of waste materials. Further, since cleaning of the connecting hose 33 is time-consuming, operation for changing a color paint affects the efficiency for painting vehicle bodies.

Meanwhile, emission regulation for carbon dioxide and regulation for toxic industrial liquid waste such as organic solvents tend to be more and more strict, and accordingly technology development in the related field is required on decreased use of organic solvents and toxic wastes in the painting line. The present invention seeks to provide a method and an apparatus for painting vehicle bodies with a variety of color paints, which eliminate the above difficulties of the prior art and satisfy the above requirements in this field.

In view of the above, the object of the invention is to provide a method of painting successively carried vehicle bodies with a suitable color paint selected from a variety of color paints, comprising the steps of:

- transferring a plurality of primary color paints along corresponding paint-transferring lines;
- selecting and extracting necessary primary color paints for preparation of said suitable color paint at the end of the paint-transferring lines and setting a certain ratio between said extracted primary color paints based on delivery rate of a delivery pump provided in the respective paint-transferring lines; and
- preparing the suitable color paint having a certain viscosity by mixing the thus extracted primary color paints at an intermediate of a paint-transferring passage connecting the end of the paint-transferring lines and a spray gun.

Another object of the invention is to provide a method of painting vehicle bodies, the method including primer coating, surfacer painting and top coating, characterized in that the surfacer painting is carried out by the aforementioned method and in that paint used for the surfacer painting has the same or similar color to that used for the top coating.

The present invention also provides an apparatus for painting successively carried vehicle bodies with a suitable color paint selected from a variety of color paints by the use of a spray gun comprising:

- a plurality of parallel paint-transferring lines, each provided with a primary color paint tank and a delivery pump;
- a primary color paint selecting/extracting unit having a change valve and connected to one end of the paint-transferring lines;
- an agitating unit provided at an intermediate of a paint-transferring passage between the primary color paint selecting/extracting unit and the spray gun and preparing the suitable color paint having a certain viscosity by mixing the primary color paints selected and extracted at the primary color paint selecting/extracting unit;

a washing unit connected at one end of the paint-transferring passage; and a control unit which, based on a previously input painting program, automatically controls:

(a) opening and closing operation of the change valve so as to select and extract necessary primary color paints for preparation of the suitable color paint;

(b) delivery rate of the respective delivery pumps in the paint-transferring lines so as to adjust the mixing ratio of the extracted primary color paints;

(c) viscosity of the suitable color paint at the agitating unit; and (d) cleaning operation in the paint-transferring passage by the washing unit.

According to the present invention, in stead of the conventional painting method and apparatus, in which all the color paints extending to 30 kinds are separately prepared and reserved in the corresponding paint tanks and supplied to the spray gun, said all the color paints are prepared from a few kinds of primary color paints reserved in corresponding primary color paint tanks. Necessary primary color paints are selected and extracted from the few kinds of primary color paints, and they are mixed such that a certain amount of a suitable color paint having a certain viscosity is prepared and supplied to the spray gun.

More specifically, the aforementioned apparatus according to the present invention is characterized in that each delivery pump comprises: a piston having a semicircular pump cavity and accommodated within a cylinder; a rotating mechanism for the piston; and a reciprocating mechanism for the piston, said cylinder being provided with two diametrically opposing first and second ports for inlet and outlet of a liquid, and the rotational movement of said piston by the rotating mechanism being in combination with the reciprocal movement of said piston by the reciprocating mechanism such that during the stroke movement of the piston one of said first and second ports is in communication with the pump cavity, while the other port is closed by the circumference wall of said piston, thereby transferring the liquid from the first port to the second port by the combination movement of said piston. Said delivery pumps in the paint-transferring lines are positioned on an arm of a vehicle body painting robot. In such embodiment the apparatus will be much smaller than the conventional painting apparatus and the paint-transferring passage to be cleaned will be also shorter. Further, in said delivery pump, since the first port and the second port are completely shut out to each other, the amount of liquid to be transferred is controlled accurately.

In the aforementioned delivery pump, preferably, said cylinder is provided with two sets of first and second ports, and said piston has two semicircular pump cavities, respectively co-operating with the corresponding set of first and second ports. Said upper and lower pump cavities are positioned symmetrical to each other about the center axis of said piston. In such arrangement, one pump cavity and the corresponding set of first and second ports may be used for paint, while the other pump cavity and the corresponding set of first and second ports may be used for washing liquid or diluent for paint. This eliminates malfunction of the delivery pump due to paint layer covered on the cylinder wall.

According a method and apparatus for painting vehicle bodies of the present invention, almost 30 kinds of color paints are prepared from a few kinds of primary paints such as 5 to 8 colors, thereby leading to simple arrangement of the paint-transferring lines. Further, since the selecting/extracting operation of necessary primary color paints may be. carried out in the proximity of the spray gun, the common paint-transferring passage between the primary color paint selecting/extracting unit and the spray gun may be shorter. This leads to reduced time for cleaning operation when changing a color paint as well as reduced amount of wastes for paints and washing liquid.

According to another object of the present invention, since paint used for the surfacer painting has the same or similar color to that used for the top coating, thickness of the top coating layer required for the uniform appearance is a half of the conventional top coating layer, thereby reducing the amount of paints to be applied. Further, since substantially the same color paint is applied for the surfacer painting and the top coating, top coating color paint is not necessary to be applied at the reverse side of the trunk lid, reverse side of the bonnet and the like parts, leading to simple operation of the top coating and reduced amount of waste paints.

Moreover, according to the structure of the delivery pump including the aforementioned particular piston, when the piston rotates and moves upward, the pump cavity is in communication with the first port so that paint flows from the first port to the pump cavity, and when the piston moves downward, the pump cavity is in communication with the second port so that the paint within the pump cavity is flown out from the second cavity. With such continuous upward and downward movement of the piston, primary color paint is transferred from the first port to the second port and delivery rate of the primary color paint can be adjusted by the rotational speed of the piston, i.e. interval of the reciprocating stroke movement of the piston. Therefore, a variety of high quality color paints can be prepared based on the delivery rate of the respective primary color paints, which is highly accurate. According to the method and the apparatus of the present invention, both solvent type paint and water-soluble paint may be used.

BRIEF DESCRIPTION OF THE DRAWINGS

FIG. 4 shows a delivery pump of the painting apparatus shown in FIG. 3, in which

DESCRIPTION OF THE PREFERRED EMBODIMENT

Figure 1:
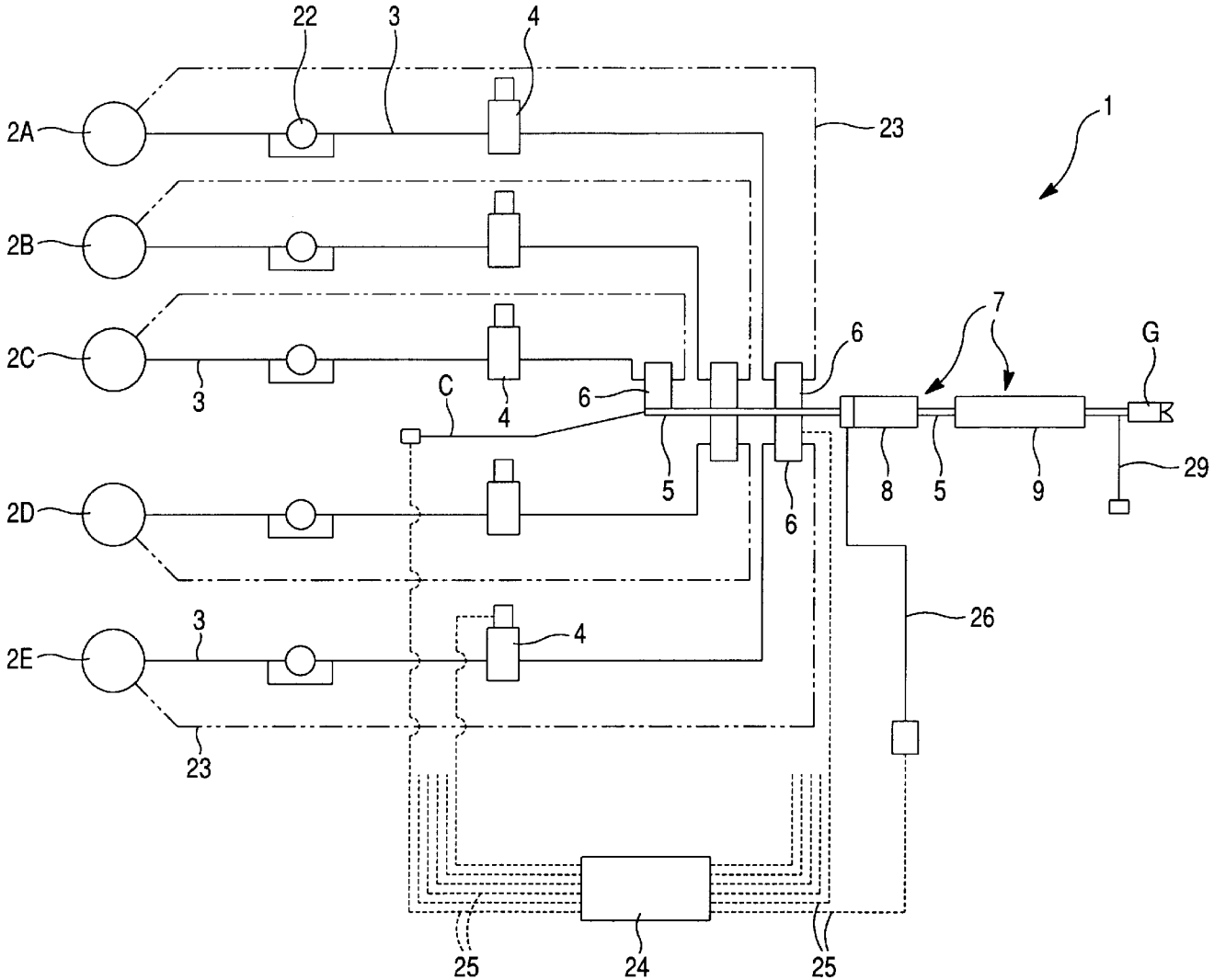
FIG. 1 shows an arrangement of a painting method and painting apparatus according to the present invention.

Referring now to the drawings, particularly to FIG. 1, there is shown one embodiment of a painting apparatus according to the present invention. A vehicle body is coated in three different steps including primer coating, surfacer painting and top coating. Color paints applied to vehicle bodies extend to almost 30 kinds. The painting apparatus 1 shown in FIG. 1 is used for surfacer painting. The painting apparatus 1 comprises 5 to 8 paint-transferring lines 3,3 . . . (five lines in the figure) for preparation of the color paints extending 30 kinds. Each paint transferring line 3 corresponds to a primary color paint tank 2A~2E for different color paint such as red, blue, yellow, white and black, and is provided with a suction booster pump 22 and a delivery pump 4. At the end of each paint-transferring line 3, a primary color paint selecting/extracting unit 6 in the form of a three-way change valve is connected. As shown in FIG. 1, a plurality of primary color paint selecting/extracting units 6, 6 . . . are also connected to a common paint-transferring passage 5 so that the primary color paints selected by changing operation of the valves are flown within the paint-transferring passage 5 while the other non-selected primary color paints are returned to the primary color paint tanks 2A~2E through return pipes 23.

The paint-transferring passage 5 is further connected to an agitating unit 7 and a spray gun G, which form a front part of the painting apparatus 1. The agitating unit 7 is for agitating and mixing the primary color paints with solvents transferred from a solvent supplying portion 26. The agitating unit 7 comprises a pool portion 8 for primary mixing the extracted primary color paints by adding the solvents, and a mixing portion 9 having agitating blades within the housing. A spray gun G is provided at the end of the paint-transferring passage 5, and a washing unit C is connected at the beginning end of the paint-transferring passage 5 so that when changing the color paint in use, the paint-transferring passage 5 is cleaned. Further, a drainage pipe 29 for liquid of wastes from the washing unit C is connected to the paint-transferring passage 5 in the proximity of the spray gun G. The front part of the painting apparatus 1 is formed by these elements.

In order to automatically prepare a suitable color paint from five primary color paints such as red, blue, yellow, white and black and automatically clean the paint-transferring passage 5 when changing a suitable color paint to be applied, the painting apparatus 1 is provided with a control unit 24. As shown in FIG. 1, the control unit 24 controls each delivery pump 4, washing unit C and the solvent supplying portion 26. The control unit 24 also controls opening and closing operation of the change valve in each primary color paint selecting/extracting unit 6. Reference numeral 25 shows a signal wire connecting each delivery pump 4, washing unit C, solvent supplying portion 26 and each primary color paint selecting/extracting unit 24 with the control unit 24.

Figure 2:
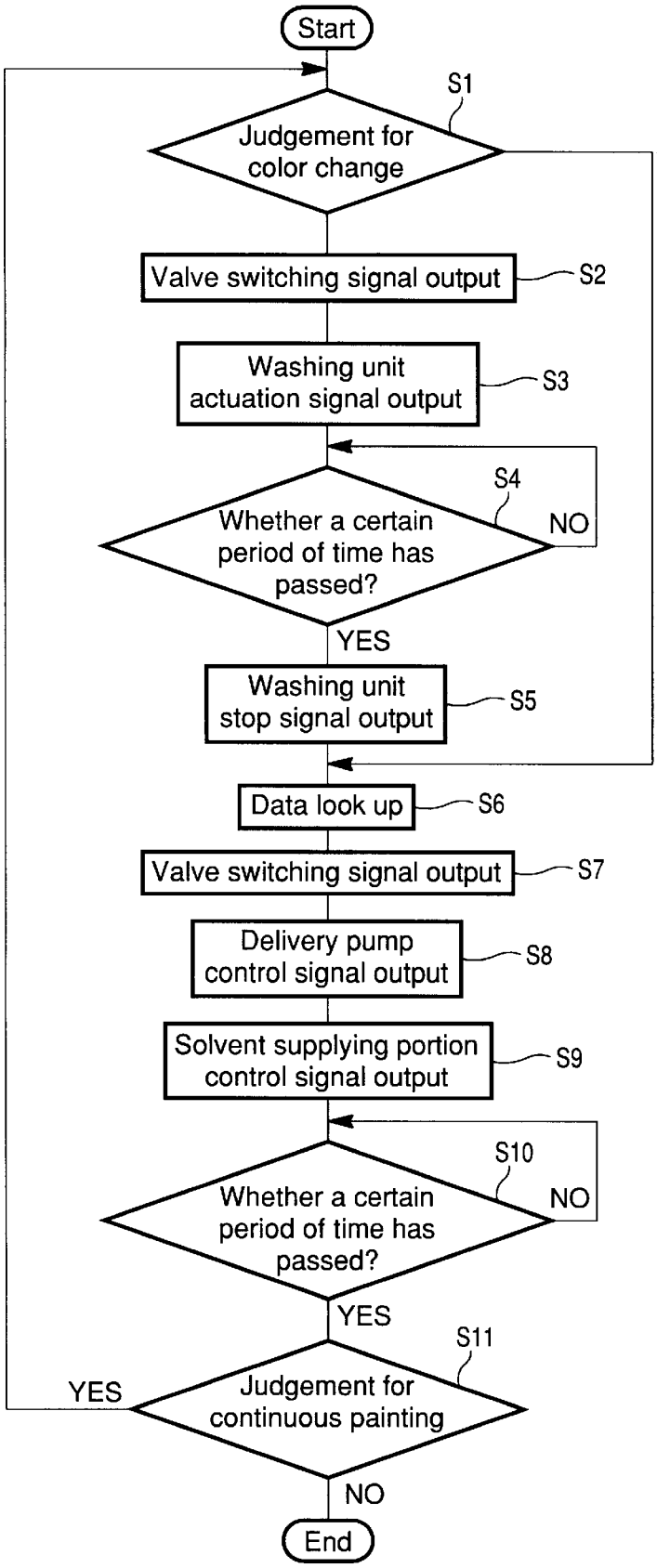
FIG. 2 is a flow chart showing the function of a control unit.

Control of these elements is carried out at the control unit 24 based on a painting program as a software program previously input in a non-shown computer. As shown in FIG. 2, judgment is carried out at a first step (S1) so as to determine whether or not the color paint in use should be changed. If the change of the color paint is necessary, then goes on to the next step (S2), otherwise goes on to step (S6) to be described later.

In the step (S2), valve switching signal is transmitted to the respective primary color paint selecting/extracting units 6, 6 . . . so as to shut down the path connecting to the paint-transferring passage 5 for the purpose of cleaning remaining paint within the paint-transferring passage 5. Subsequently, actuation signal is transmitted to the washing unit C (S3). After a certain period of time (S4) (for example 6 seconds) required for the cleaning operation of the paint-transferring passage 5, stop signal is transmitted to the washing unit C (S5).

The next step (S6) is for looking up a data map relative to the mixing ratio of the necessary primary color paints for preparation of the suitable color paint to be applied and the mixing ratio of the solvents so as to prepare a suitable color paint within the paint-transferring passage 5. Valve switching signal is then transmitted to the corresponding primary color paint selecting/extracting units 6, 6 . . . for preparation of the suitable color paint (S7). The path connecting to the paint-transferring passage 5 is open by the valve switching signal, and selection/extraction of the necessary primary color paints is carried out. Subsequently, in order to control delivery rate of the respective delivery pumps 4,4 . . . based on the mixing ratio of the necessary primary color paints, control signal is transmitted to the delivery pumps 4,4 . . . (S8). Also, in order to control the amount of the solvents to be added at the pool portion 8 based on the mixing ratio of the solvents, control signal is transmitted to the solvent supplying portion 26 (S9).

After a certain period of time (for example 6 seconds) required for preparation of the new suitable color paint within the paint-transferring passage 5 between the mixing portion 9 and the spray gun G (S10), the prepared suitable color paint is applied from the spray gun G. Therefore, vehicle bodies are coated with the suitable color paint, which is substantially the same or similar color paint to that used for the top coating. When surfacer painting is completed, judgment is carried out so as to determine whether or not the painting operation should be continued (S11). If the painting operation should be continued, then returns to the step (S1).

In the above painting apparatus 1, when changing the color paint in use, the valve in each primary color paint selecting/extracting unit 6 shuts down the path connecting to the paint-transferring passage 5 and the washing unit C is automatically actuated, thereby automatically cleaning the paint-transferring passage 5. This is controlled by the steps S1~S5. When preparing a suitable color paint, the valve in the corresponding primary color paint selecting/extracting unit 6 opens the path communicating with the paint-transferring passage 5. Delivery rate of each delivery pump 4 is controlled based on the mixing ratio of the respective primary color paints. The amount of the solvents to be added in the pool portion 8 is also controlled based on the mixing ratio of the solvents. As a result, the suitable color paint having a certain viscosity is prepared at the agitating unit 7 in the paint-transferring passage 5 by selecting necessary primary colors from the primary color paints such as red, blue, yellow, white and black. The prepared suitable color paint is transferred to the spray gun G and applied to vehicle bodies. The aforementioned steps are repeated during painting operation of the vehicle bodies.

In the above painting apparatus, since a variety of color paints are prepared from a few kinds of primary color paints at the agitating unit 7, size of the painting unit will be smaller. Further, the agitating unit 7 is positioned in the proximity of the spray gun G so as to ensure reduced time for cleaning operation within the paint-transferring passage 5 and reduced amount of wastes for paints and washing liquid. As a result, improved production efficiency and reduced production cost can be achieved.

According to another embodiment of the invention, vehicle bodies coated for surfacer painting by the above painting operation are further coated for top coating with the same or similar color paint used for the surfacer painting. Since paint used for the surfacer painting has the same or similar color to that used for the top coating, thickness of the top coating layer required for uniform appearance is a half of the conventional top coating layer, thereby reducing the amount of paints to be applied. Further, since substantially the same color paint is applied for the surfacer painting and the top coating, top coating color paints may not be applied to the reverse side of the trunk lid and the like. This leads to reduced amount of waste paints and simple operation of the top coating. As a result, improved production efficiency and reduced production cost can be achieved.

Figure 3A:
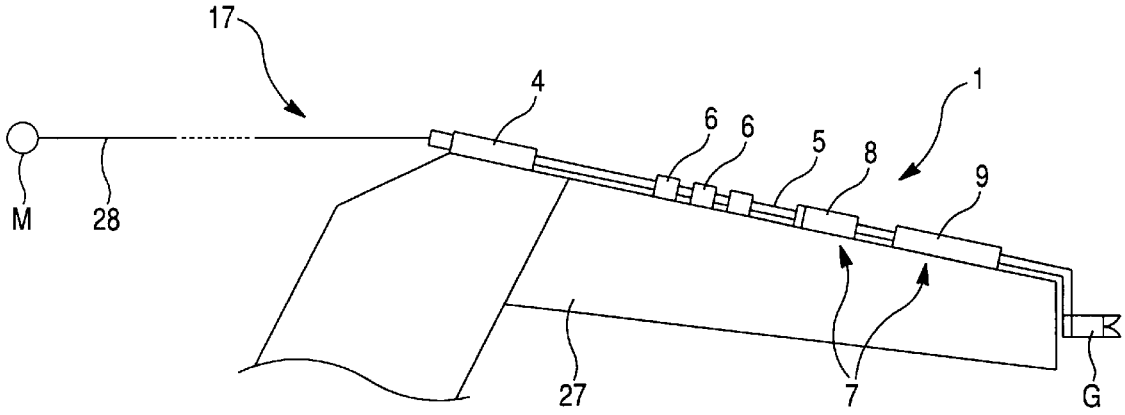
FIG. 3 shows one embodiment of a painting apparatus according to the present invention, in which FIGS. 3A and 3B respectively show a side view and a plan view of the painting apparatus.
Figure 3B:
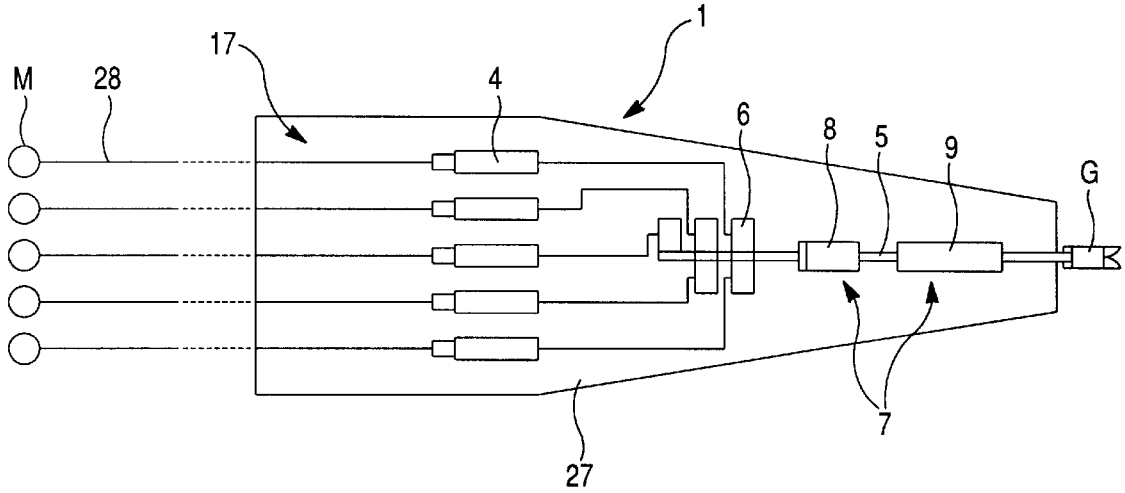
Figure 4A:
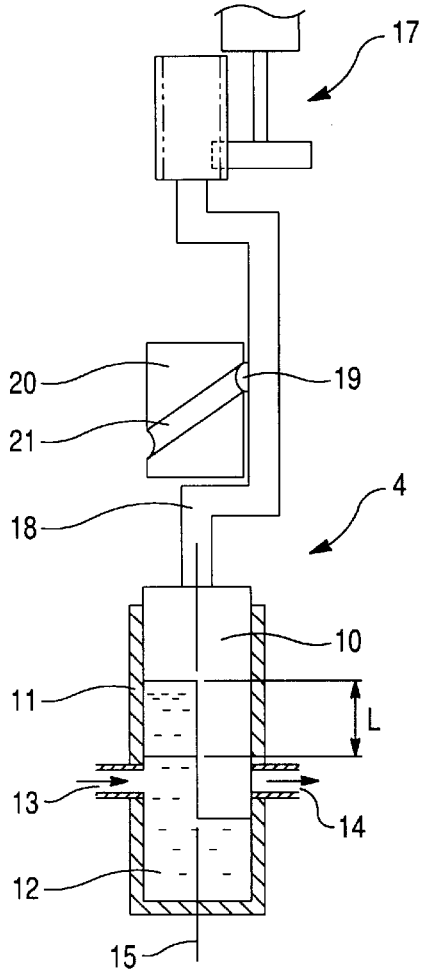
FIG. 4A is a vertical section showing the piston at its top dead center.
Figure 4B:
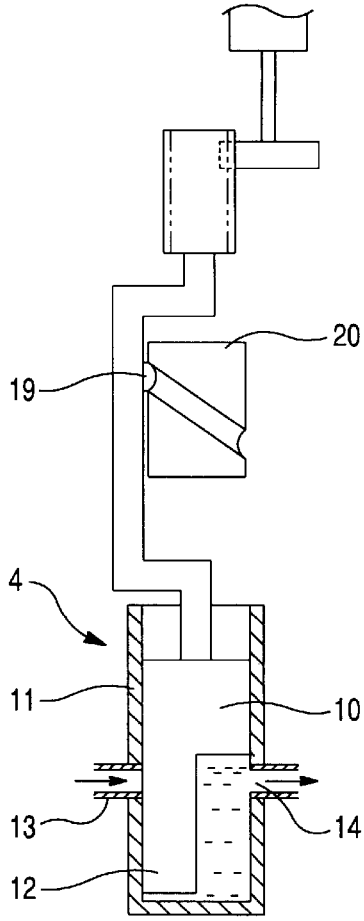
FIG. 4B is a vertical section showing the piston at its bottom dead center, and FIG. 4C and FIG. 4D explain the operation of the piston in correspondence with FIGS. 4A and 4B.
Figure 4C:
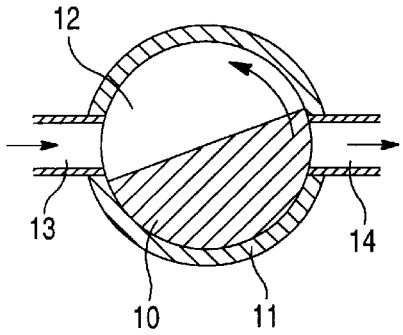
Figure 4D:
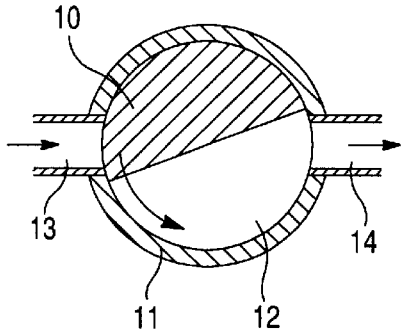

Referring to FIGS. 3 and 4, there is shown another painting apparatus 1 according to the present invention, in which a part of the painting apparatus 1 including the arrangement from the delivery pumps 4, 4 . . . to the spray gun G is mounted on an arm 27 of a vehicle body painting robot. As to the delivery pump 4, a small and light weight piston pump such as disclosed in Japanese Patent Application No.10-94121 is employed so as to ensure accurate control of the delivery rate of the primary color paint.

As shown in FIG. 4, a piston pump of the delivery pump 4 mainly comprises a cylinder 11 and a piston 10 accommodated within the cylinder 11. The piston 10 is provided at one end with a semicircular pump cavity 12 which is formed by cutting a part of the piston along its longitudinal axis 15. The other end of the piston 10 is provided with a rotating mechanism and a reciprocating mechanism, which are positioned adjacent to a piston shaft 18. The rotational movement of the piston 10 around the longitudinal axis 15 is in combination with the reciprocal movement (stroke movement L) of the piston 10. The combination movement of the piston 10 is achieved with the provision of the rotating mechanism and the reciprocating mechanism.

As shown in FIGS. 3 and 4, the rotating mechanism of the piston 10 includes a driving portion 17, which comprises an electric motor M apart from the arm 27, and a cable 28 connecting the electric motor M and the piston shaft 18. The reciprocating mechanism of the piston 10 employs a circular cylinder cam mechanism. As shown in FIG. 4, in the circular cylinder cam mechanism, a cam pin 19 on a piston shaft 18 is engaged with a cam groove 21 provided on the circumference wall of the circular cylinder 20 The combination movement of the piston 10 is such that when the piston 10 is rotated in forward direction or reverse direction, the piston 10 is reciprocated. In other words, when the piston 10 completes one full circular rotating movement around the longitudinal axis of the piston 10, the piston 10 completes a full stroke including upward and downward stroke movements and returns to the original position.

The cylinder 11 is provided with two diametrically opposing first and second ports 13, 14 for inlet and outlet of a liquid. The first port 13 is in communication with the pump cavity 12 when the piston 10 moves from its bottom dead center to its top dead center during the half rotational movement of the piston 10. In such position of the piston 10, the second port 14 opposing to (180° away from) the first port 13 is closed by the circumference wall of the piston 10. As a result, a liquid (primary color paint) is flown from the first port 13 to the pump cavity 12. When the piston 10 moves downwardly during the other half rotational movement, the pump cavity 12 is in communication with the second port 14. The liquid within the pump cavity 12 is then flown into the second port 14 by the downward pressurizing stroke movement of the piston 10. With repeated rotational and stroke movement of the piston 10, the liquid is transferred from the first port 13 to the second port 14.

In the delivery pump 4 including the above piston pump, since the first port 13 and the second port are completely shut out to each other, the amount of liquid to be transferred can be controlled accurately. Further, since the delivery pumps 4, 4 . . . are positioned parallel on the arm 27 of the vehicle body painting robot and rotational speed of each piston 10 is separately adjusted by controlling rotational speed of each electric motor M through control unit 24, delivery rate of the liquid to be transferred is controlled accurately.

In the above painting apparatus 1, since the delivery pump 4 is small and light weight and a part of the painting apparatus 1 including the arrangement from the delivery pumps 4, 4 . . . to the spray gun G is mounted on the arm 27 of the vehicle body painting robot, the paint-transferring passage 5 to be cleaned when changing the color paint in use becomes much shorter than the conventional passage. This leads to reduced time for cleaning the paint-transferring passage 5 and reduced amount of wastes for paints and washing liquid. As a result, improved production efficiency and reduced production cost can be achieved. Further, the delivery pump 4 including the above piston pump ensures accurate adjustment of the delivery rate, such as of an error of 1~2 grams per minute so that quality of a suitable color paint prepared and applied to the vehicle bodies is improved.

Figure 5A:
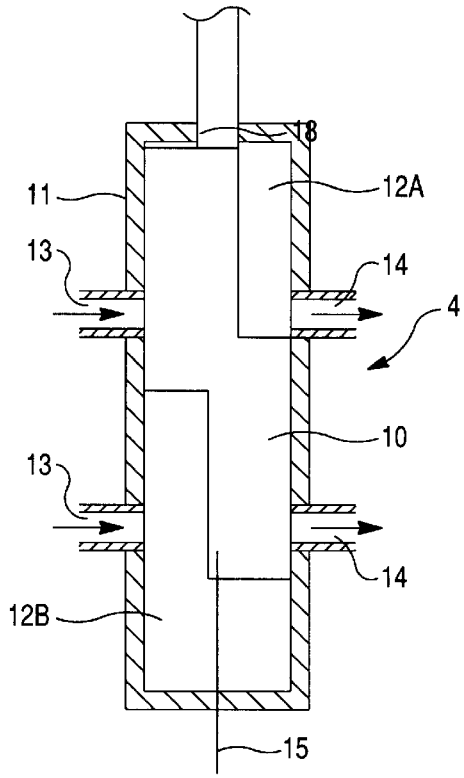
FIG. 5A is a vertical section showing another embodiment of a delivery pump according to the present invention.

Referring to FIG. 5A, another embodiment of a piston pump will be described. This piston pump may be used for the above delivery pump 4. The piston pump comprises first and second semicircular pump cavities 12A, 12B, which are positioned opposite (180° away) to each other around the longitudinal axis 15 of the piston 10. The cylinder 11 is provided with a set of first and second ports 13, 14 corresponding to the first pump cavity 12A and another set of first and second ports 13, 14 corresponding to the second pump cavity 12B. The piston pump further includes a rotational mechanism and a reciprocating mechanism such as shown in FIG. 4.

In the piston pump shown in FIG. 5A, waving on the surface of the transferred paint will be reduced since the liquid (primary color paint) in turn flows into and out from the two sets of pump cavities 12A, 12B during half rotational and half stroke movement of the piston 10. This is advantageous for reduced size of the painting apparatus since provision of an accumulator for waving prevention is not necessary. Further, since size of the painting apparatus will be smaller, reduced time for cleaning operation when changing a color paint to be applied as well as reduced amount of washing liquid can be achieved.

In the piston pump shown in FIG. 5A, for example the second pump cavity 12B and the corresponding first and second ports 13, 14 may be used for paint, while the first pump cavity 12A and the corresponding first and second ports 13, 14 may be used for washing liquid or diluent, which is for washing and removing the remaining paint between the piston 10 and the cylinder 11. This eliminates malfunction of the delivery pump due to paint layer covered on the cylinder wall.

Figure 5B:
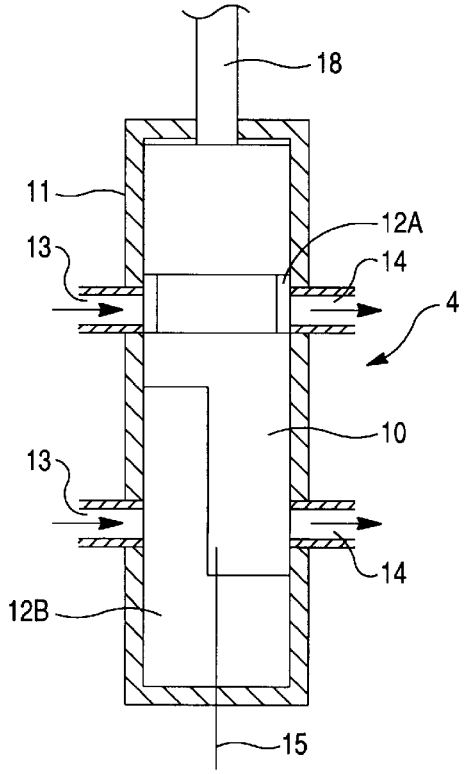
FIG. 5B is a vertical section showing a modified embodiment of the delivery pump shown in FIG. 5A.
Figure 6:
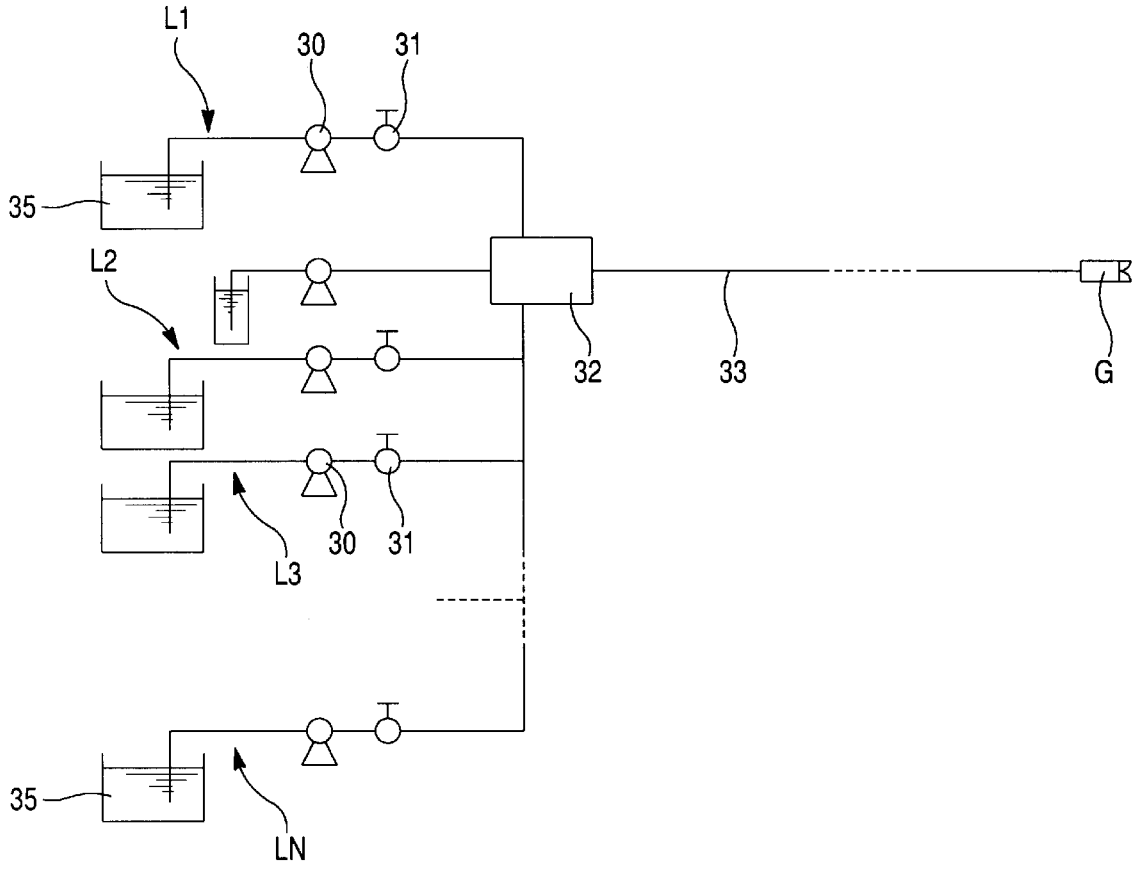
FIG. 6 is an explanatory view showing a prior art painting apparatus.

As shown in FIG. 5B, the first pump cavity 12A of the piston pump shown in FIG. 5A may be formed as an annular groove provided around the peripheral wall of the piston 10.

It is to be understood that the present invention is not limited to the above embodiments. For example, the painting apparatus 1 may be used for top coating. Also, the delivery pump 4 may be other known type. Further, the reciprocating mechanism of the piston shown in FIG. 4 may be any known mechanism other than circular cylinder cam mechanism.

What is claimed is:

1. A method of painting successively carried vehicle bodies with a suitable color paint selected from a variety of primary color paints, comprising the steps of:

transferring a plurality of primary color paints along corresponding paint-transferring lines;

selecting and extracting necessary primary color paints for preparation of said suitable color paint at an end of the paint-transferring lines and setting a certain volume ratio between said extracted primary color paints based on delivery rate of said extracted primary color paints by a delivery pump provided in the respective paint-transferring lines;

preparing the suitable color paint having a certain viscosity by mixing the thus extracted primary color paints along a paint-transferring passage intermediate to and in communication with the end of the paint-transferring lines and a spray gun adapted to direct said suitable color paint toward said successively carried vehicle bodies; painting said successively carried vehicle bodies with said suitable color paint using said spray gun; and selectively cleaning said paint-transferring passage by delivering washing liquid directly from a washing unit to said paint-transferring passage while bypassing said paint-transferring lines.

2. A method of painting vehicle bodies, the method including primer coating, surfacer painting and top coating, characterized in that the surfacer painting is carried out by the method according to claim 1 and in that paint used for the surfacer painting has the same or similar color to that used for the top coating.

3. A method of painting successively carried members with a suitable color paint selected from a variety of color paints, comprising the steps of: transferring a plurality of primary color paints along corresponding paint-transferring lines; selecting and extracting necessary primary color paints for preparation of said suitable color paint at an end of the paint-transferring lines and setting a certain volume ratio between said extracted primary color paints based on delivery rate of said extracted primary color paints by a delivery pump provided in the respective paint-transferring lines; preparing the suitable color paint having a certain viscosity by mixing the thus extracted primary color paints along a paint-transferring passage intermediate to and in communication with the end of the paint-transferring lines and a spray gun adapted to direct said suitable color paint toward said successively carried members; painting said successively carried members with said suitable color paint using said spray gun; and selectively cleaning said paint-transferring passage by delivering washing liquid directly from a washing unit to said paint-transferring passage while bypassing said paint-transferring lines.

* * * * *